US009482160B2

(12) United States Patent
Sasaki et al.

(10) Patent No.: US 9,482,160 B2
(45) Date of Patent: Nov. 1, 2016

(54) VALVE CONTROL DEVICE

(71) Applicant: DENSO CORPORATION, Kariya, Aichi-pref. (JP)

(72) Inventors: Kazushi Sasaki, Obu (JP); Hiroki Shimada, Anjo (JP); Ryo Sano, Kariya (JP)

(73) Assignee: DENSO CORPORATION, Kariya (JP)

( * ) Notice: Subject to any disclaimer, the term of this patent is extended or adjusted under 35 U.S.C. 154(b) by 321 days.

(21) Appl. No.: 13/914,998

(22) Filed: Jun. 11, 2013

(65) Prior Publication Data

US 2013/0333648 A1 Dec. 19, 2013

(30) Foreign Application Priority Data

Jun. 15, 2012 (JP) ..... 2012-136186

(51) Int. Cl.
*F02D 13/02* (2006.01)
*F02D 41/00* (2006.01)

(52) U.S. Cl.
CPC ..... *F02D 13/0242* (2013.01); *F02D 41/0072* (2013.01); *F02D 41/0077* (2013.01); *F02M 26/54* (2016.02); *F02M 26/66* (2016.02)

(58) Field of Classification Search
CPC ..... F02M 25/07561; F02M 25/0773; F02M 25/0788; F02M 25/0789; F02M 25/079; F02M 25/0793; F02M 25/0794; F02D 41/0072; F02D 41/0077
See application file for complete search history.

(56) References Cited

U.S. PATENT DOCUMENTS 6,386,188 B1 * 5/2002 Bender ..... 123/568.12
6,390,079 B1 5/2002 Gagnon et al.
6,443,135 B1 * 9/2002 Dismon et al. ..... 123/568.18
8,833,730 B2 * 9/2014 Sawada ..... F16K 7/16 251/129.11
2004/0040798 A1 * 3/2004 Fujita et al. ..... 188/156
2007/0089708 A1 * 4/2007 Katsuno et al. ..... 123/396
2007/0240676 A1 * 10/2007 Sasaki ..... F02D 9/04 123/337
2007/0240677 A1 * 10/2007 Sasaki ..... F16K 1/221 123/337
2007/0240690 A1 * 10/2007 Nanba ..... F16K 31/041 123/568.18
2008/0078593 A1 * 4/2008 Ortmann et al. ..... 180/65.2

(Continued)

FOREIGN PATENT DOCUMENTS

JP 2007-285173 11/2007
JP 2009-534007 9/2009

(Continued)

OTHER PUBLICATIONS

Feb. 3, 2016 Office Action issued in Chinese Patent Application No. 201310235021.7 (with translation).

*Primary Examiner* — Stephen K Cronin
*Assistant Examiner* — Anthony L Bacon
(74) *Attorney, Agent, or Firm* — Nixon & Vanderhye P.C.

(57) ABSTRACT

A cam full close stopper defines a cam full close position that is a limit position of a rotatable range of a cam. A sensor element outputs a signal corresponding to a rotation angle of the cam. A signal processor changes the signal output from the sensor element into a sensor output. A storage part memorizes a data table representing a correspondence relationship between the rotation angle of the cam and the sensor output of the signal processor in a predetermined form, characteristics of the sensor output being adjustable at a plurality of points with respect to the rotation angle of the cam. The storage part memorizes the sensor output of the signal processor when the cam is fully closed at the cam full close position.

12 Claims, 10 Drawing Sheets

(56) References Cited

U.S. PATENT DOCUMENTS

| | | | | |
|---|---|---|---|---|
| 2009/0114391 | A1* | 5/2009 | Smith et al. | 166/305.1 |
| 2009/0235766 | A1 | 9/2009 | Keefover et al. | |
| 2013/0166172 | A1 | 6/2013 | Hara et al. | |

FOREIGN PATENT DOCUMENTS

| | | |
|---|---|---|
| JP | 2011-74933 | 4/2011 |
| JP | 2011-247399 | 12/2011 |

* cited by examiner

VALVE CONTROL DEVICE

CROSS REFERENCE TO RELATED APPLICATION

This application is based on Japanese Patent Application No. 2012-136186 filed on Jun. 15, 2012, the disclosure of which is incorporated herein by reference in its entirety.

TECHNICAL FIELD

The present disclosure relates to a valve control device.

BACKGROUND

JP-2009-534007A (WO 2007/117473, US 2009/0235766) describes a valve control device including a valve drive unit and a rotation angle detector. The valve drive unit activates a valve stem (shaft) of a poppet valve to reciprocate in the axial direction (stroke direction) so as to adjust a flow rate of exhaust gas. The rotation angle detector detects an actual opening of a valve by measuring a rotation angle of an output gear. The valve control device controls a motor so that the actual opening of the valve detected by the rotation angle detector is controlled to be equal to a target value.

The valve drive unit includes an actuator which has the motor as source of power, a deceleration mechanism which slows down rotations of the motor by two steps, and a spring which generates elastic power biasing the poppet valve to return from a valve open position to a full close position.

The deceleration mechanism has a pinion gear, a middle gear in addition to the output gear. The pinion gear is fixed to an output shaft of the motor. The middle gear is rotated by engaging with the pinion gear. The output gear is rotated by engaging with the middle gear. The output gear rotates around an output gear shaft provided to an actuator housing. Moreover, the output gear integrally has a cam slot which changes the rotary motion of the actuator into the rectilinear motion of the valve stem. The cam slot has a groove shape corresponding to the operation pattern of the poppet valve.

The cam slot of the output gear is coupled with a bearing attached to an input unit of the valve stem by a pin inserted into the cam slot. Moreover, the poppet valve is combined with an output unit of the valve stem. Furthermore, the cam slot has a cam full close stopper which regulates the rotation of the output gear by colliding with the bearing at a cam full close position, when the output gear rotates to exceed the full close position of the poppet valve.

In the valve control device, the output gear and the cam slot are rotated by the torque of the motor. Thus, the bearing, the pin, the valve stem and the poppet valve are moved to reciprocate in the axial direction of the valve stem, such that the poppet valve is seated on or lifted from the valve seat which defines a valve full close position.

Moreover, the rotation angle detector has a rotation angle sensor which outputs a sensor signal corresponding to the rotation angle of the output gear as a cam rotation angle to an electronic control unit. As shown in FIG. 8, the sensor output (voltage) characteristics are set with respect to the cam rotation angle by two points that are the valve full open position J2 and the valve full close position J1 (at which the flow rate is zero).

That is, in the characteristic line (i.e., the sensor output characteristics line with respect to the cam rotation angle) shown in the lower graph of FIG. 8, the sensor output is written at the valve full close position J1 when the poppet valve is fully closed, and is written at the valve full open position J2 when the poppet valve is fully opened.

However, the cam full close position is unclear (different among EGR control valves) with respect to the valve full close position, due to a dimension R0. Therefore, when the poppet valve is seated on the valve seat to be held at the valve full close position, that is when the poppet valve is controlled to be fully closed, the sensor output (voltage) may be varied with respect to the cam full close position.

By this reason, the poppet valve may overshoot the target position when the poppet valve is controlled from the valve open position to the valve full close position. At this time, the bearing may contact to the cam full close stopper. In this case, the valve drive unit such as the gear, the cam and the motor may be deformed or damaged, so that the durability may be lowered.

SUMMARY

It is an object of the present disclosure to provide a valve control device having high durability.

According to an example of the present disclosure, a valve control device includes a valve unit, a cam, an actuator, a cam full close stopper, a sensor element, a signal processor and a storage part. The valve unit opens and closes a passage. The cam has a slot shaped to correspond to an operation pattern of the valve unit. The actuator drives a rotation shaft of the cam. The cam full close stopper defines a cam full close position that is a limit position of a rotatable range of the cam. The sensor element outputs a signal corresponding to a rotation angle of the cam. The signal processor changes the signal output from the sensor element into a sensor output. The storage part memorizes a data table representing a correspondence relationship between the rotation angle of the cam and the sensor output of the signal processor in a predetermined form, and characteristics of the sensor output is adjustable at a plurality of points with respect to the rotation angle of the cam. The storage part memorizes the sensor output of the signal processor when the valve unit is fully opened as a valve full open position. The storage part memorizes the sensor output of the signal processor when the valve unit is fully closed as a valve full close position. The storage part memorizes the sensor output of the signal processor when the cam is fully closed at the cam full close position.

Accordingly, the durability of the valve control device can be improved.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
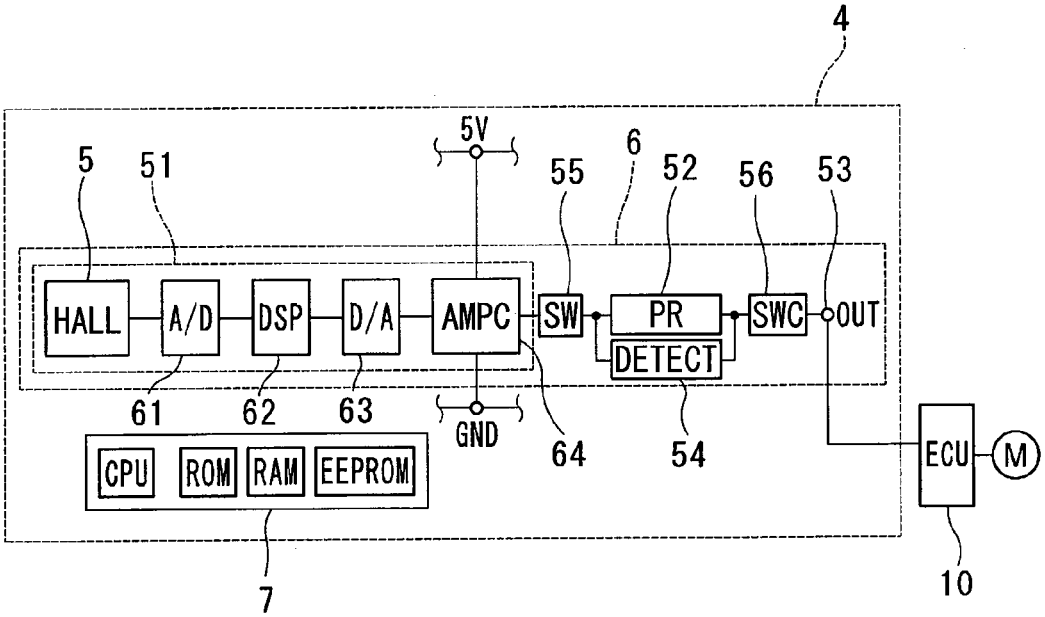
FIG. 1 is a schematic block diagram illustrating an electric circuit of a valve control device according to a first embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

An exhaust gas recirculation (EGR) control valve according to a first embodiment will be described with reference to FIGS. 1 to 5 as an example of a valve control device.

An internal combustion engine for a vehicle has an EGR system which recirculates exhaust gas from an exhaust pipe back to an intake pipe as EGR gas. The EGR system has an EGR gas pipe which refluxes the EGR gas from an exhaust manifold or passage to an intake manifold or passage. An EGR gas passage is defined in the EGR gas pipe, and the EGR gas flows into the intake passage from the exhaust passage through the EGR gas passage.

Figure 2:
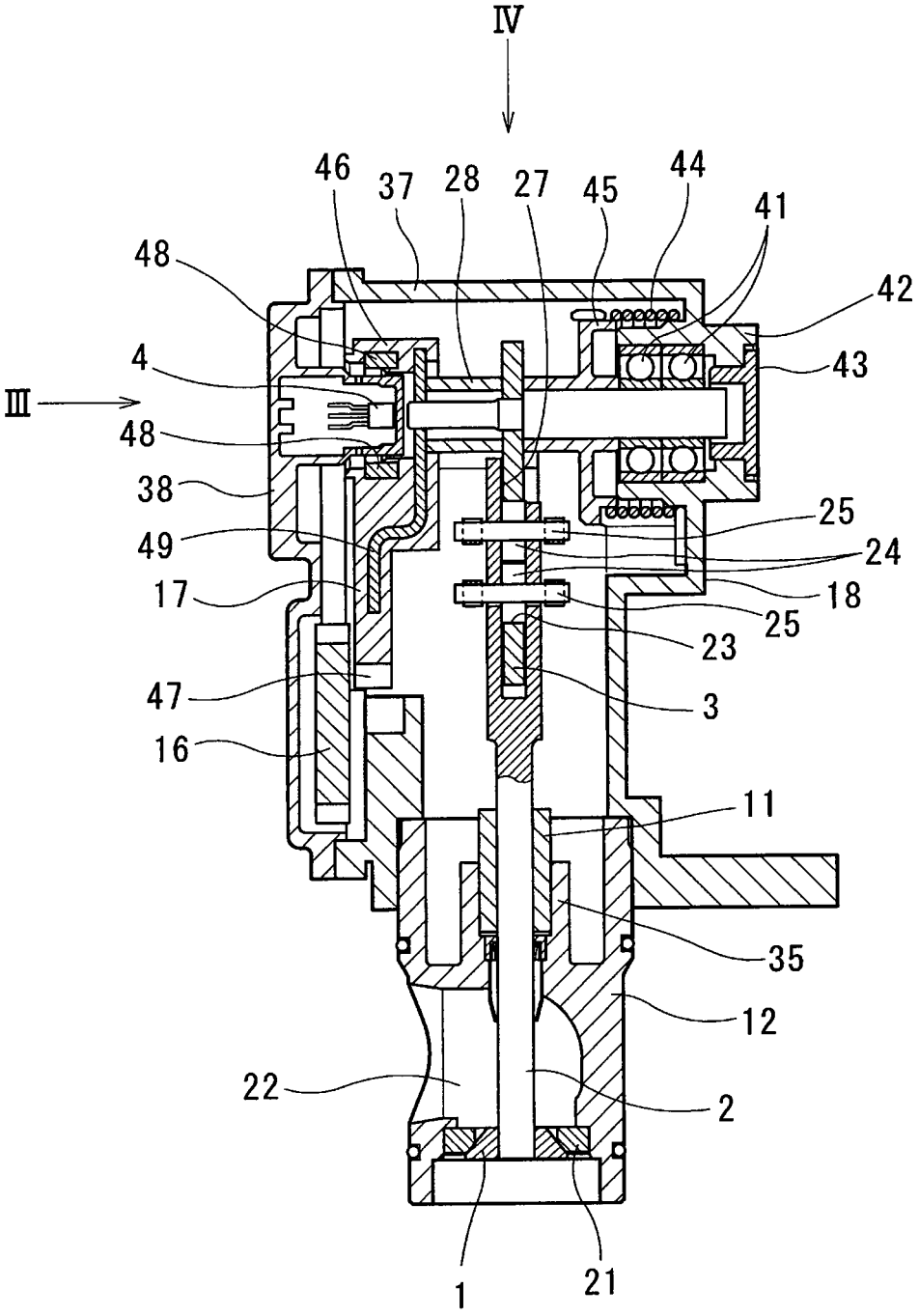
FIG. 2 is a schematic cross-sectional view illustrating the valve control device of the first embodiment.

An EGR control valve is installed in the EGR gas pipe, and controls the flow rate of the EGR gas flowing through the EGR gas passage by opening or closing a poppet valve 1 shown in FIG. 2.

The EGR system is used as an EGR valve control device (EGR control device for the internal combustion engine) which opens and closes the poppet valve 1. The poppet valve 1 is a main body of the EGR control valve and is controlled based on an operation condition of the internal combustion engine. The EGR valve control device has a rotation angle detector which detects a rotation angle of a plate cam 3 which opens and closes a valve stem 2 corresponding to a valve shaft of the poppet valve 1. The poppet valve 1 and the valve stem 2 may be referred as a valve unit.

As shown in FIG. 1, the rotation angle detector has a rotation angle sensor 4 and an electronic control unit (ECU) 10 for the internal combustion engine. The ECU 10 detects a stroke amount of the poppet valve 1, or the rotation angle of the plate cam 3 based on the sensor output of the rotation angle sensor 4. The sensor output characteristics can be adjusted with respect to the rotation angle of the plate cam 3 in plural points. The stroke amount of the poppet valve 1 may represent a valve stroke or a flow rate. The rotation angle of the plate cam 3 may be referred as a cam rotation angle.

The rotation angle sensor 4 has an integrated circuit 6 and a microcomputer 7. The integrated circuit 6 converts a signal output from a Hall device 5 into the predetermined sensor output. The microcomputer 7 has a memory such as EEPROM which memorizes data table representing a correspondence relationship between the cam rotation angle and the sensor output of the integrated circuit 6 with a predetermined form, and initial data that is necessary for obtaining the sensor output characteristics. Details of the rotation angle detector are mentioned later.

The EGR control valve has a valve drive unit and a valve body 12. The valve drive unit reciprocates the valve stem 2 of the poppet valve 1, which opens and closes the EGR gas passage, in the axial direction. The valve body 12 supports the valve stem 2 slidably in the axial direction through a bearing 11, as shown in FIG. 2.

The valve drive unit has an actuator, a converter, a housing 18, a full open stopper 19, and the rotation angle sensor 4. The actuator has a motor M which generates the rotation power which drives the poppet valve 1, and a deceleration mechanism constructed by a pinion gear 15, a middle gear 16, and an output gear 17. The deceleration mechanism slows down the rotation of the motor shaft 13 of the motor M by two steps, and transmits the rotation to an output gear shaft 14. The converter has the plate cam 3 fixed to the output gear shaft 14, and converts the rotary motion of the actuator into the linear motion of the valve stem 2. The housing 18 may correspond to an actuator case which accommodates the actuator. The full open stopper 19 regulates the poppet valve 1 at the full open position. The full open position may be a full-open-side limit position in a rotatable range of the plate cam 3. The rotation angle sensor 4 detects the rotation angle of the plate cam 3.

The poppet valve 1 has a cylindrical flange corresponding to a main body and the valve stem 2. The cylindrical flange is seated on or separated from a valve seat 21 of the valve body 12 so as to close or open a passage 22 corresponding to the EGR gas passage. The valve stem 2 reciprocates in the axial direction by interlocking with the rotational displacement of a cam slot 23 of the plate cam 3.

Figure 3:
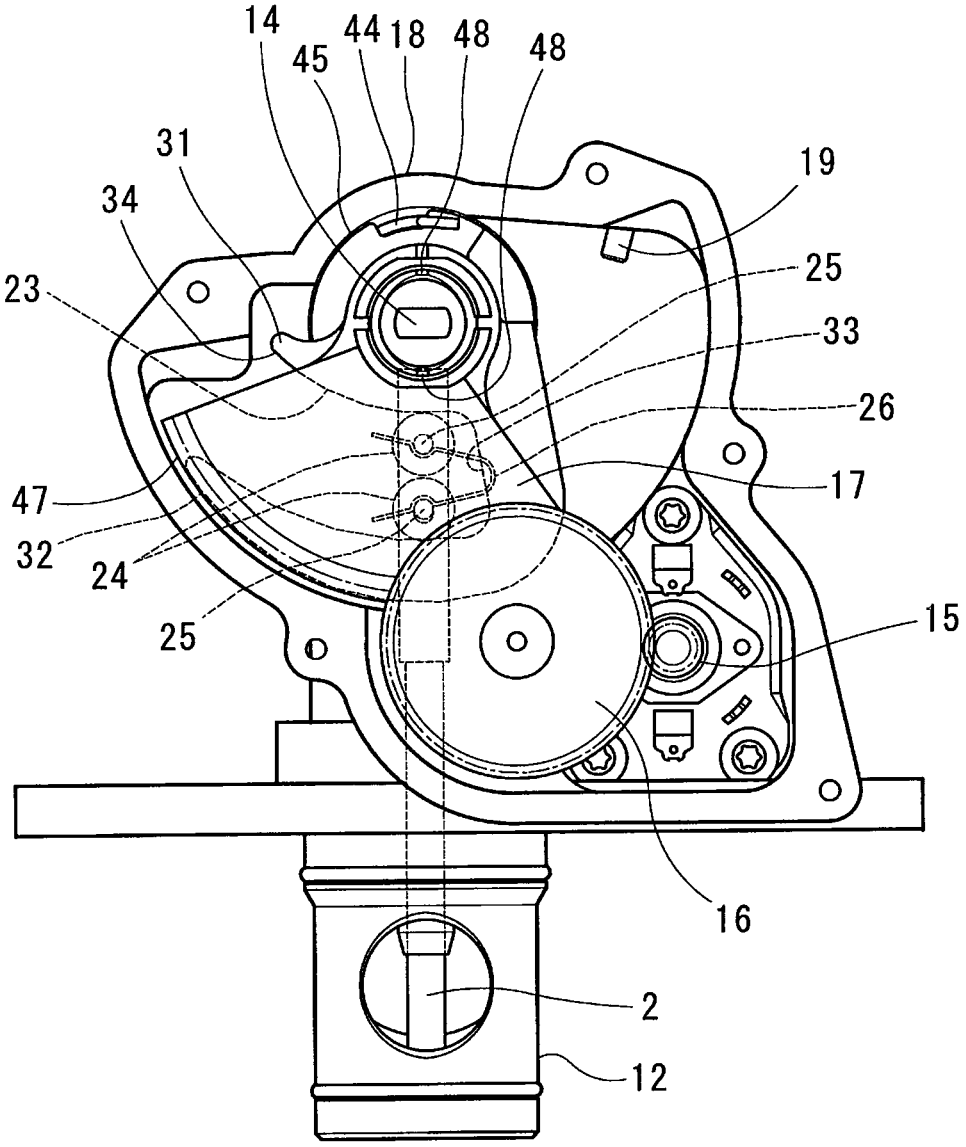
FIG. 3 is a schematic side view illustrating the valve control device of the first embodiment in a direction of III in FIG. 2.

As shown in FIGS. 2 and 3, the poppet valve 1 is located at a full close position, when an engagement part (a ball bearing 24, a pivot pin 25, and a spring 26 shown in FIG. 3) of the valve stem 2 is located at the first end side of the cam slot 23 of the plate cam 3 in the longitudinal direction of the cam slot 23. In contrast, the poppet valve 1 is located at a full open position, when the engagement part of the valve stem 2 is located at the second end side of the cam slot 23 in the longitudinal direction of the cam slot 23.

The valve stem 2 is extended in the axial direction, and is coupled with the poppet valve 1 and the converter including the plate cam 3.

A first end part of the valve stem 2 in the axial direction has an input unit to which the power of the actuator is transmitted from the plate cam 3. A second end part of the valve stem 2 in the axial direction has an output unit which outputs the power of the actuator to the poppet valve 1.

As shown in FIG. 2, the input unit of the valve stem 2 has two opposing parts (i.e., first branch and second branch)

opposing with each other by separation. The two opposing parts oppose with each other through a slit 27, and the output unit of the plate cam 3 is inserted into the slit 27.

Each of the two opposing parts of the input unit of the valve stem 2 has a first fitting hole and a second fitting hole. Two of the pivot pins 25 are fitted to the respective fitting holes so as to penetrate in the axial direction of the pivot pin 25.

The plate cam 3 has a circular input unit which surrounds the periphery of the output gear shaft 14 in the circumference direction, as shown in FIG. 3. A square-shaped fitting hole is defined in the input unit of the plate cam 3. Thereby, the plate cam 3 is fixed to the output gear shaft 14 not to rotate relative to the output gear shaft 14.

The input unit of the plate cam 3 is arranged between an annular stepped surface of the output gear shaft 14 and an annular end face of a metallic collar 28 shown in FIG. 2, and is fixed, in this state, to the periphery of the middle diameter part of the output gear shaft 14. With respect to the output gear 17, the input unit of the plate cam 3 is separated by a predetermined distance that is equal to the axial length of the metallic collar 28, as shown in FIG. 2.

As shown in FIG. 3, the plate cam 3 has a sector-shaped output unit which partially surrounds the circumference of the input unit. The output unit has an outside diameter approximately equal to the maximum outside diameter part of the output gear 17. Moreover, the output part has the cam slot (cam groove) 23 with the curved shape corresponding to the opening-and-closing operation pattern of the poppet valve 1. The cam slot 23 penetrates the plate cam 3 in the thickness direction. The opening-and-closing operation pattern may correspond to a lift amount of the poppet valve 1 relative to the rotation angle of the plate cam 3.

The input unit of the plate cam 3 has the fitting hole such as square hole for fittingly fixed to the periphery of the output gear shaft 14 of the deceleration mechanism, separately from the output gear 17. Moreover, the output unit of the plate cam 3 has the cam slot 23 for engaging with the engagement part of the valve stem 2.

The cam slot 23 is the guide groove which extends with the predetermined curvature radius from the first end side to the second end side of the plate cam 3 in the rotational direction. The first end side may be a cam full close side corresponding to the valve full close position of the poppet valve 1. The second end side may be a cam full open side corresponding to the valve full open position of the poppet valve 1.

Here, the rotation angle of the plate cam 3 and the cam shape (profile) of the cam slot 23 are determined relative to the stroke amount of the valve stem 2 required to drive the poppet valve 1 from the valve full close position to the valve full open position. The stroke amount may correspond to a valve stroke or a flow rate.

As shown in FIG. 3, the output unit of the plate cam 3 has an inner part 31 and an outer part 32. The inner part 31 is a circular inside protrusion piece formed on the inner side of the plate cam 3 in the radial direction rather than the cam slot 23. The outer part 32 is a circular outside protrusion piece formed on the outer side of the plate cam 3 in the radial direction rather than the cam slot 23.

A cam full close stopper (regulation wall) 33 is arranged on the cam full close side of the cam slot 23 to connect the inner part 31 and the outer part 32 with each other, thereby regulating the two of ball bearings 24 from moving further toward the cam full close side.

An opening (notch) 34 is provided on the cam full open side of the cam slot 23, and opens to outside of the plate cam 3 in the rotational direction corresponding to the longitudinal direction of the cam slot 23. The opening 34 provides a valve subassembly port for inserting the valve subassembly into the cam slot 23 at the time of attachment. The valve subassembly includes the poppet valve 1, the valve stem 2, the valve body 12, the ball bearing 24, the pivot pin 25, the spring 26, and the like.

A full open stopper part which is stopped by the full open stopper 19 is integrally provided to the plate cam 3 or an interlocking component such as the output gear shaft 14 and the output gear 17. The interlocking component is connected to be integrally rotatable with the plate cam 3.

As shown in FIG. 2, a cylindrical bearing holder 35 is integrally formed with the valve body 12, and holds the periphery of the bearing 11 which slidably pivots the valve stem 2 in the axial direction.

Figure 4:
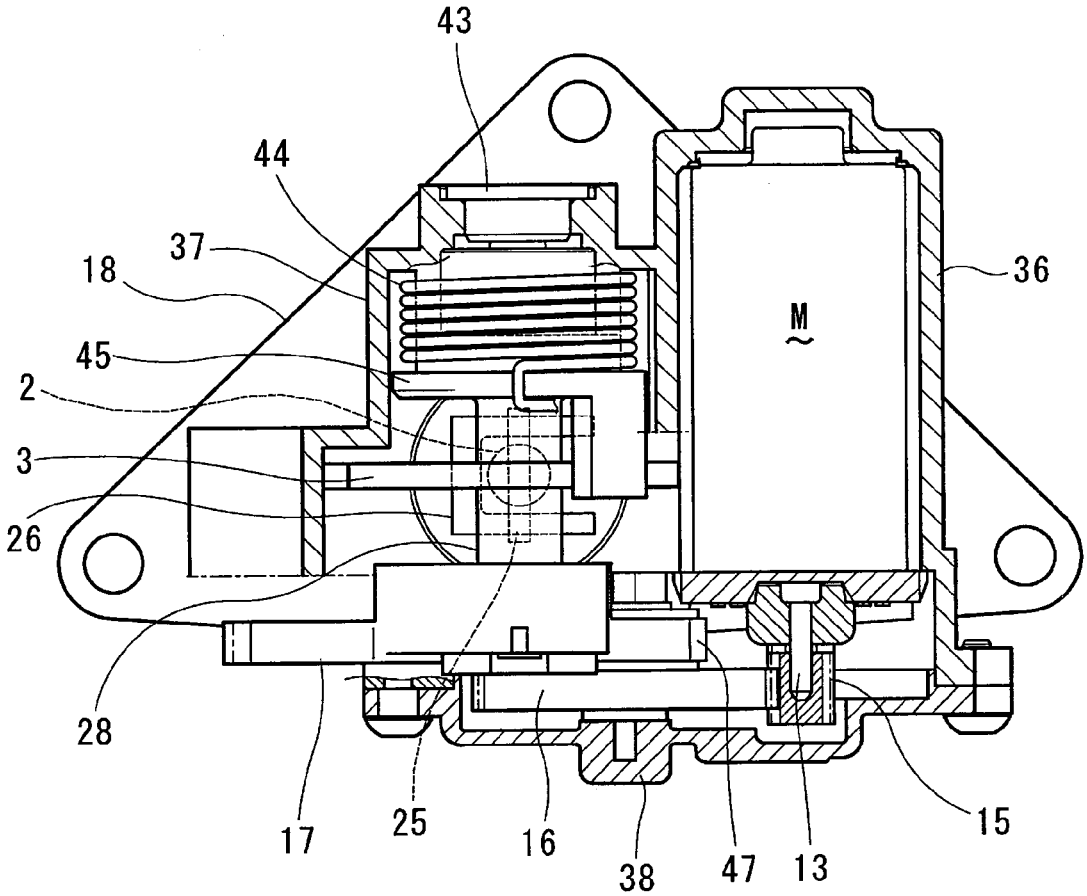
FIG. 4 is a schematic top view illustrating the valve control device of the first embodiment in a direction of IV in FIG. 2.

As shown in FIG. 4, the housing 18 has a motor case 36 accommodating and holding the motor M, and a gear case 37 accommodating the deceleration mechanism, the converter and the valve stem 2.

The housing 18 has an opening through which the actuator is inserted into the gear case 37 at the time of attachment. The opening is closed by a sensor covering 38.

As shown in FIG. 2, a cylindrical bearing holder 42 is arranged adjacent to the bottom of the housing 18 (i.e., the bottom of the gear case 37). The cylindrical bearing holder 42 is arranged to surround the circumference of the two-gang ball bearing 41 in the circumference direction. The cylindrical bearing holder 42 has an opening opened to outside. The opening is gas-tightly closed by a cap 43.

The full open stopper 19 has a head part to be engaged with a tool, and an axis part extending from the head part toward the plate cam 3 or the interlocking component. For example, the full open stopper 19 may be made of an adjustment screw which can control the cam full open position. The full open stopper 19 is fixed by screwing the axis part so as to project from the end face of the outer wall part of the gear case 37 of the housing 18. Moreover, the full open stopper 19 works as not only the full open position stopper for the plate cam 3 but also the full open position stopper for the valve, for example, which defines the full open position (full lift amount) of the poppet valve 1, and the full stroke amount of the valve stem 2.

The actuator has the motor M, the pinion gear 15, the middle gear 16, the output gear 17 and the return spring 44. The motor M generates rotation power (torque) by receiving supply of electric power. The pinion gear 15 is fixed to the motor shaft 13 of the motor M. The middle gear 16 rotates by meshing with the pinion gear 15. The output gear 17 rotates by meshing with the middle gear 16. The return spring 44 returns the poppet valve 1 from the valve open position to the full close position.

The metallic collar 28 is arranged to the periphery of the output gear shaft 14 for separating the plate cam 3 and the output gear 17 by a predetermined axial distance. Moreover, each inner race ring of the two-gang ball bearing 41 and a cylindrical bushing 45 are press-fitted to the periphery of the output gear shaft 14.

The output gear 17 is integrally molded by a synthetic resin material. A cylindrical magnet rotor 46 is integrally arranged to the inner circumference part of the output gear 17. Moreover, the output gear 17 has a partially-cylindrical-shaped maximum outside diameter part on the radially outer side rather than the magnet rotor 46. The maximum outside diameter part has plural projection teeth (output gear teeth 47) meshing with the middle gear 16 in the sector shape having a predetermined angle.

A sensor magnet 48 made of a permanent magnet is fixed to the inner circumference of the magnet rotor 46. Moreover, an output gear lever 49 is insert-molded on the magnet rotor 46. The output gear lever 49 has a fitting hole with width across flat which restricts the skid of the output gear shaft 14. Thereby, the output gear 17 is fixed to the tip periphery of the output gear shaft 14 in the axial direction through the output gear lever 49, not to rotate.

The converter is a movement direction conversion mechanism which converts the rotary motion of the actuator (i.e., the output gear shaft 14 of the deceleration mechanism) into the rectilinear motion of the valve stem 2 of the poppet valve 1. The movement direction conversion mechanism includes the plate cam 3, the two ball bearings (cam follower) 24, the two pivot pins 25 and the spring 26. The plate cam 3 is connected to be integrally rotatable with the output gear lever 49 of the output gear 17 at the center corresponding to the center axis of the output gear shaft 14. The cam follower is made of the two ball bearings 24 guided to be movable along the respective wall face of the cam slot 23 of the plate cam 3. The two pivot pins 25 are pressingly fitted with the inner race of the respective ball bearings 24, and support the outer race of the respective ball bearings 24 to be rotatable. The spring 26 is in elastic contact to the two pivot pins 25.

The two pivot pins 25 may correspond to a pivot inserted to be movable in the cam slot 23, and receive the power of the actuator from the plate cam 3 through the two ball bearings 24.

The spring 26 is an elastic member which biases the ball bearings 24 to be pressed on the respective wall face of the cam slot 23.

The ball bearings 24, the pivot pins 25, and the spring 26 are inserted to be movable in the slit 27 defined between the two opposing parts, together with the output unit of the plate cam 3.

The rotation angle detector will be described in detail. The rotation angle detector has the rotation angle sensor 4 and the ECU 10. The rotation angle sensor 4 measures the rotation angle of the magnet rotor 46 connected with the output gear shaft 14 and the output gear 17 in integrally rotatable state, thereby detecting the rotation angle of the plate cam 3 as the cam rotation angle. The ECU 10 detects the valve stroke (or the flow rate) or the cam rotation angle based on the sensor output of the rotation angle sensor 4.

The rotation angle sensor 4 is held and interposed between the opposing parts of a stator core arranged to the sensor attachment part of the sensor covering 38. The rotation angle sensor 4 is installed to project from the sensor attachment part toward the output gear shaft 14. The rotation angle sensor 4 is mainly constructed by a Hall IC, and outputs a voltage signal (analog signal) to the ECU 10. The voltage signal corresponds to a flux density interlinkaged with the sensing surface of a semiconductor Hall element. The Hall IC may be replaced with a single Hall device or non-contact type magnetism sensing element such as magnetoresistive element.

The rotation angle sensor 4 has the Hall IC (constructed by a Hall device 5 and the integrated circuit 6) and the microcomputer 7. The Hall IC is provided to the sensor magnet 48 and the rotor yoke to be relatively rotatable. The microcomputer 7 controls the integrated circuit 6 of the Hall IC.

The Hall IC is a magnetic sensor in which the Hall device 5 which may correspond to a sensor element and the integrated circuit 6 which may correspond to a signal processor are integrated into a circuit as one IC chip (semiconductor chip).

The Hall device 5 is a non-contact type magnetic detector which detects the flux of magnetic induction (magnetism) emitted from the sensor magnet 48 fixed to the inner circumference of the output gear 17 and the magnet rotor 46 connected with the plate cam 3 or the output gear shaft 14 of the plate cam 3 to be integrally rotatable. The Hall device 5 is made of semiconductor membrane, and outputs the voltage signal (analog signal) corresponding to the flux density interlinkaged with the sensing surface of the semiconductor Hall device.

As shown in FIG. 1, the integrated circuit 6 has a linear-voltage output circuit 51, a protection resistance 52 (PR), an output terminal 53, an abnormality detecting circuit 54, an electric current interception switch 55 and a voltage switch circuit 56. The integrated circuit 6 may correspond to a signal processor.

The linear-voltage output circuit 51 has the Hall device 5, an analog-digital conversion circuit 61 (A/D conversion circuit), a digital signal processor 62 (DSP), a digital-analog conversion circuit 63 (D/A conversion circuit), and an amplifier circuit (conversion circuit) 64.

The A/D conversion circuit 61 is an analog-digital converter which converts an analog signal outputted from the Hall device 5 to a digital signal.

The DSP 62 is specialized to the digital signal processing, and executes the various programs memorized by the memory, thereby performing processing such as correcting processing and rotation angle computing processing, relative to the signal converted into the digital signal after outputted from the Hall device 5.

The D/A conversion circuit 63 is a digital-analog converter which converts a digital signal outputted from the DSP 62 to an analog signal.

The amplifier circuit 64 has an operational amplifier, a controlling circuit, and a transistor. The amplifier circuit 64 changes a signal outputted from the D/A conversion circuit 63 into a voltage corresponding to the signal. The operational amplifier is an amplifying circuit which amplifies the signal outputted from the D/A conversion circuit 63 with a predetermined amplification factor (gain).

The amplifier circuit 64 is set to linearly increase the output voltage of the linear-voltage output circuit 51 according to the rotation angle of the plate cam 3.

The protection resistance 52 is connected to the amplifier circuit 64, and protects the integrated circuit from an instantaneous large electric current.

The output terminal 53 is electrically connectable to the ECU 10, and outputs the output voltage of the integrated circuit 6 to the ECU 10.

The abnormality detecting circuit 54 determines whether large electric current is flowing through the protection resistance 52. If it is determined that large electric current is flowing into the protection resistance 52, a control signal is outputted to the electric current interception switch 55 and the voltage switch circuit 56.

The electric current interception switch 55 is disposed between the amplifier circuit 64 and the protection resistance 52. The electric current interception switch 55 is a normally-on switch. Specifically, the electric current interception switch 55 is ON while not operating, and is turned off when operated. The electric current interception switch 55 is set to ON when the integrated circuit 6 is normal.

On the other hand, while large electric current is flowing into the protection resistance 52, the electric current interception switch 55 is turned off by the control signal of the abnormality detecting circuit 54. Thus, the flow of electric current between the amplifier circuit 64 and the protection resistance 52 is stopped.

The voltage switch circuit 56 is disposed between the protection resistance 52 and the output terminal 53. A first end of the voltage switch circuit 56 is electrically connected to a source line, and a second end of the voltage switch circuit 56 is electrically connected to the ground (GND) line. The voltage switch circuit 56 has a high potential switch and a low potential switch. When the high potential switch is ON and when the low potential switch is OFF, the output voltage of the output terminal is controlled to become higher than a middle voltage between the source line and the ground line. In contrast, when the high potential switch is set to OFF and when the low potential switch is set to ON, the voltage switch circuit 56 controls the output voltage of the output terminal to become lower than the middle voltage between the source line and the ground line.

At an abnormality time where large electric current is flowing into the protection resistance 52, the voltage switch circuit 56 is activated by the control signal of the abnormality detecting circuit 54, and controls the output voltage of the output terminal to high (HI) or low (LO).

The microcomputer 7 has a CPU and a memory (ROM, RAM, and EEPROM). The CPU performs various computing, processing, and controlling by a program. The program for the CPU is stored in the ROM beforehand. In the RAM, information obtained in the computing of the CPU is recorded temporarily. The temporarily recorded information is deleted when an ignition switch is turned off.

At the time of shipment, information (initial data) for the CPU is stored in the EEPROM beforehand. Specifically, the data table shown in the upper part of FIG. 5, which represents the correspondence relationship between the cam rotation angle and the valve stroke (or the flow rate) in a predetermined format, is stored in the EEPROM beforehand. Moreover, the data table shown in the lower part of FIG. 5, which represents the correspondence relationship between the cam rotation angle and the sensor output of the integrated circuit 6 in a predetermined format, is stored in the EEPROM beforehand. In addition, information which specifies the use of the integrated circuit 6 is beforehand memorized in the EEPROM. The EEPROM may correspond to a storage part.

The motor M which is a drive source of the actuator is electrically connected to a battery (not shown) mounted in the vehicle through a motor drive circuit which is electronically controlled by the ECU 10.

The ECU 10 has a well-known microcomputer including the central processing unit (CPU), the memory (ROM and RAM) which stores a control program, control logic or a variety of control data such as map, an input circuit, an output circuit, a power circuit and a timer.

The ECU 10 may correspond to a stroke amount detector which detects a stroke amount of the poppet valve 1 as a valve stroke based on the sensor output outputted from the rotation angle sensor 4, or a flow rate detector which detects a flow rate of gas in the passage 22 based on the sensor output outputted from the rotation angle sensor 4. Moreover, the ECU 10 may correspond to a cam angle detector which detects the rotation angle of the plate cam 3 as the cam rotation angle based on the sensor output outputted from the rotation angle sensor 4.

When the ignition switch is turned on (IG-ON), the ECU 10 calculates the stroke amount (valve opening) of the poppet valve 1 based on the control program stored in the memory of the microcomputer and the sensor output outputted from the rotation angle sensor 4. Further, the ECU 10 calculates the control amount of the motor M which is the source of power based on the stroke amount, and outputs the calculation result to the actuator.

Specifically, the electric power supplied to the motor M of the EGR control valve receives feedback control in a manner that the sensor output outputted from the rotation angle sensor 4 agrees with a target opening (target lift amount, target stroke amount). The target opening corresponds to a control set point (target EGR rate, target EGR opening) set in accordance with the engine operation condition such as rotation speed, accelerator opening or engine load.

The rotation angle sensor 4, an airflow meter, a crank angle sensor, an accelerator opening sensor, a throttle opening sensor, an intake air temperature sensor, a circulating-water-temperature sensor, and an exhaust gas sensor such as air fuel ratio sensor or oxygen concentration sensor output sensor signals. The output sensor signals are A/D converted by the A/D conversion circuit, and input into the microcomputer of the ECU 10.

The rotation angle sensor 4, the airflow meter, the crank angle sensor, the accelerator opening sensor, the throttle opening sensor, the intake air temperature sensor, the circulating-water-temperature sensor, and the exhaust gas sensor may construct an operational status detector which detects the operational status (operation condition) of the engine.

The crank angle sensor is comprised of a pickup coil for converting the rotational angle of the crankshaft of the engine into an electrical signal and outputs a NE pulse signal every 30° CA, where CA represents a crank angle, to the ECU 10.

The ECU 10 serves as a rotational speed detector which detects an engine rotational speed (engine speed: NE) by measuring an interval time of the NE pulse signals outputted from the crank angle sensor.

The accelerator opening sensor may be an engine load detector which detects the press amount of the accelerator as the accelerator opening. The engine load detector may be made of a throttle opening sensor instead of the accelerator opening sensor.

The ECU 10 calculates the control set point (target opening) set to correspond to an engine operation condition, when the ignition switch is turned on (IG-ON).

When the engine load is low, and when the engine rotation velocity is in a low range, that is, in idle operation time, the introduction of EGR gas is stopped (EGR cut), so as to stabilize the engine combustion. In this case, the full close operation of the poppet valve 1 is carried out using the power of the motor M.

When a driver presses the accelerator, the engine is in a predetermined operating range (for example, load is from low to middle and rotation speed is from low to middle), the ECU 10 calculates the control set point (target opening) set to correspond to the operating range such as engine load and engine rotation speed.

At this time, the ECU 10 controls the poppet valve 1 to open with a predetermined valve opening (valve stroke) or more. The target opening may be set to, for example, the valve full open position.

When a driver presses the accelerator, the engine is in a predetermined operating range (for example, load is high and rotation speed is high), the ECU 10 calculates the control set point (target opening) set to correspond to the operating range such as engine load and engine rotation speed.

At this time, the ECU 10 sets the control set point (target opening) to the valve full close position, and the introduction of EGR gas is stopped (EGR cut). Thus, the engine output is restricted from falling when a driver presses the accelerator so as to increase the engine output to the maximum extent, because the EGR gas is not introduced into the combustion chamber of the engine. Also in this case, the full close operation of the poppet valve 1 is carried out using the power of the motor M, similarly to the idle operation time.

A method of controlling the sensor output will be described in detail. In FIG. 1, a reference voltage with respect to the rotation angle sensor 4 is set to 5V.

First, the cap 43 is removed, and the output gear shaft 14, which is the rotation shaft of the plate cam 3, is rotated in a valve opening direction. Thus, the full open stopper part attached to the plate cam 3 or the interlocking component (the output gear shaft 14, the output gear 17) is contacted to the full open stopper 19. Therefore, the rotation angle (position) of the plate cam 3 is made to correspond to the valve full open position.

Figure 5:
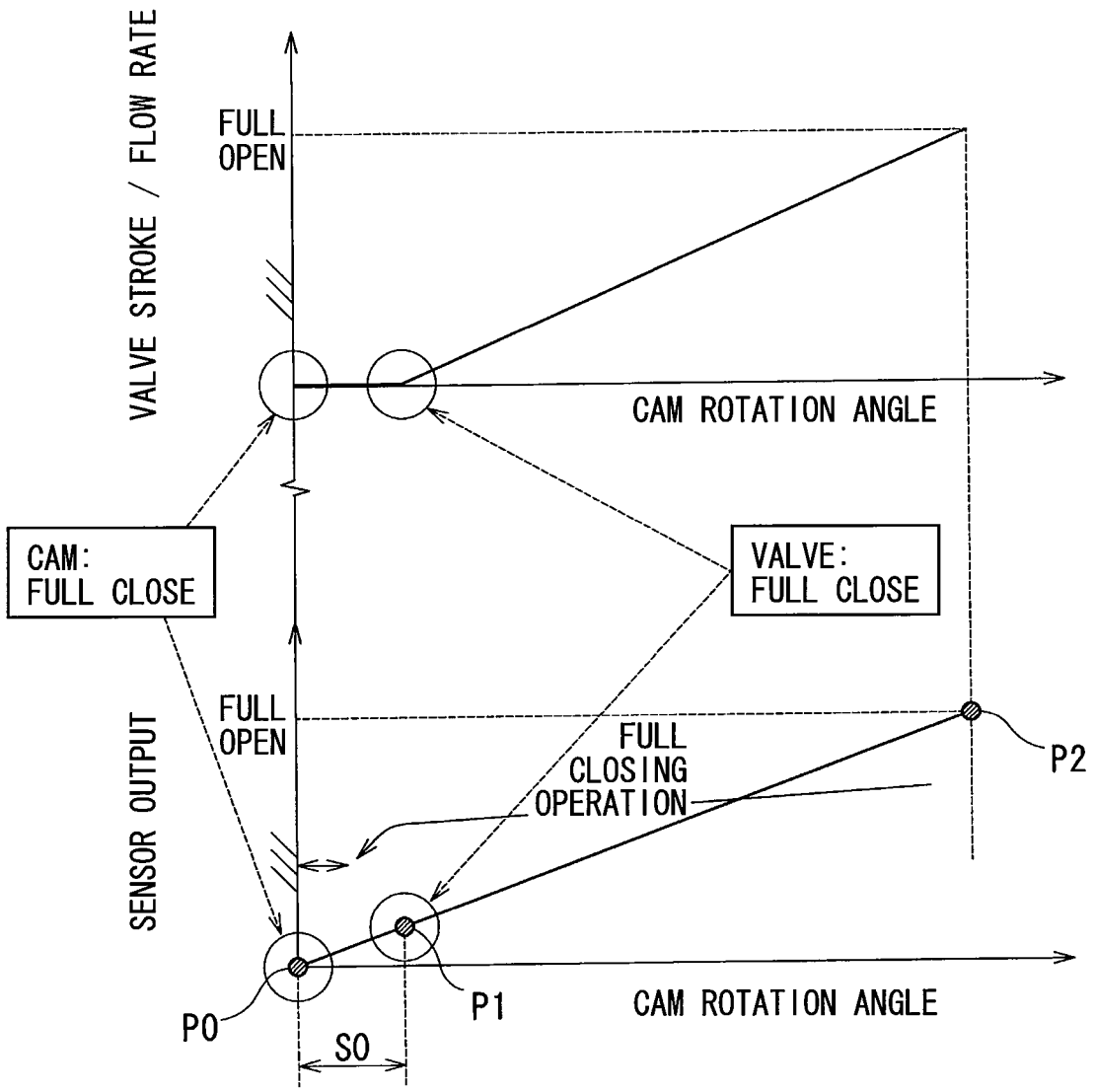
FIG. 5 is an explanatory drawing illustrating a valve stroke and a sensor output with respect to a cam rotation angle in the valve control device of the first embodiment.

At this time, as shown in FIG. 5, the sensor output (voltage) outputted from the integrated circuit 6 of the rotation angle sensor 4 is raised to a voltage value corresponding to the valve full open position. For example, the sensor output becomes the maximum in the characteristic line of the data table, which is characteristics line of the sensor output with respect to the cam rotation angle.

Then, the sensor output (voltage) at this time is taken into the EEPROM as the valve full open position P2. That is, the valve full open position P2 is written on the characteristic line of the data table.

Then, the output gear shaft 14, which is the rotation shaft of the plate cam 3, is rotated in a valve closing direction, thereby seating the poppet valve 1 to the valve seat 21. Thus, the rotation angle (position) of the plate cam 3 is made to correspond to the valve full close position.

At this time, as shown in FIG. 5, the sensor output (voltage) outputted from the integrated circuit 6 of the rotation angle sensor 4 is lowered to the voltage value corresponding to the valve full close position. Then, the sensor output (voltage) at this time is taken into the EEPROM as the valve full close position P1. That is, the valve full close position P1 is written on the characteristic line of the data table.

Then, the output gear shaft 14, which is the rotation shaft of the plate cam 3, is further rotated in the valve closing direction. Thus, the engagement part (the ball bearing 24, the pivot pin 25, and the spring 26) of the valve stem 2 is made to contact to the cam full close stopper 33 of the cam slot 23. Therefore, the rotation angle (position) of the plate cam 3 is made to correspond to the cam full close position.

At this time, as shown in FIG. 5, the sensor output (voltage) outputted from the integrated circuit 6 of the rotation angle sensor 4 is lowered to the voltage value corresponding to the cam full close position. For example, the sensor output becomes the minimum in the characteristic line of the data table.

Then, the sensor output (voltage) at this time is taken into the EEPROM as the cam full close position P0. That is, the cam full close position P0 is written on the characteristic line of the data table.

The point P0 in FIG. 5 represents the write point of the sensor output at the cam full close position. The point P1 in FIG. 5 represents the write point of the sensor output at the valve full close position. The point P2 in FIG. 5 represents the write point of the sensor output at the valve full open position.

The point P0 taken in the EEPROM is the write point of the sensor output at the cam full close position. The point P1 taken in the EEPROM is the write point of the sensor output at the valve full close position. The point P2 taken in the EEPROM is the write point of the sensor output at the valve full open position.

The sensor output corresponding to the other points between the point P0 and the point P1 is computed by the linear interpolation between the point P0 and the point P1. The sensor output corresponding to the other points between the point P1 and the point P2 is computed by the linear interpolation from the point P1 and the point P2.

By carrying out such output adjustment, it is possible to create the data table representing the correspondence relationship between the cam rotation angle and the sensor output of the integrated circuit 6 with a predetermined format. That is, the characteristics of the sensor output (voltage) with respect to the cam rotation angle can be defined.

The EEPROM updates and memorizes the sensor output (voltage) characteristics relative to the cam rotation angle. In this case, the initial data of the sensor output characteristics beforehand memorized in the EEPROM can be rewritten easily.

Thus, the sensor output adjustment of the rotation angle sensor 4 can be performed.

Figure 8:
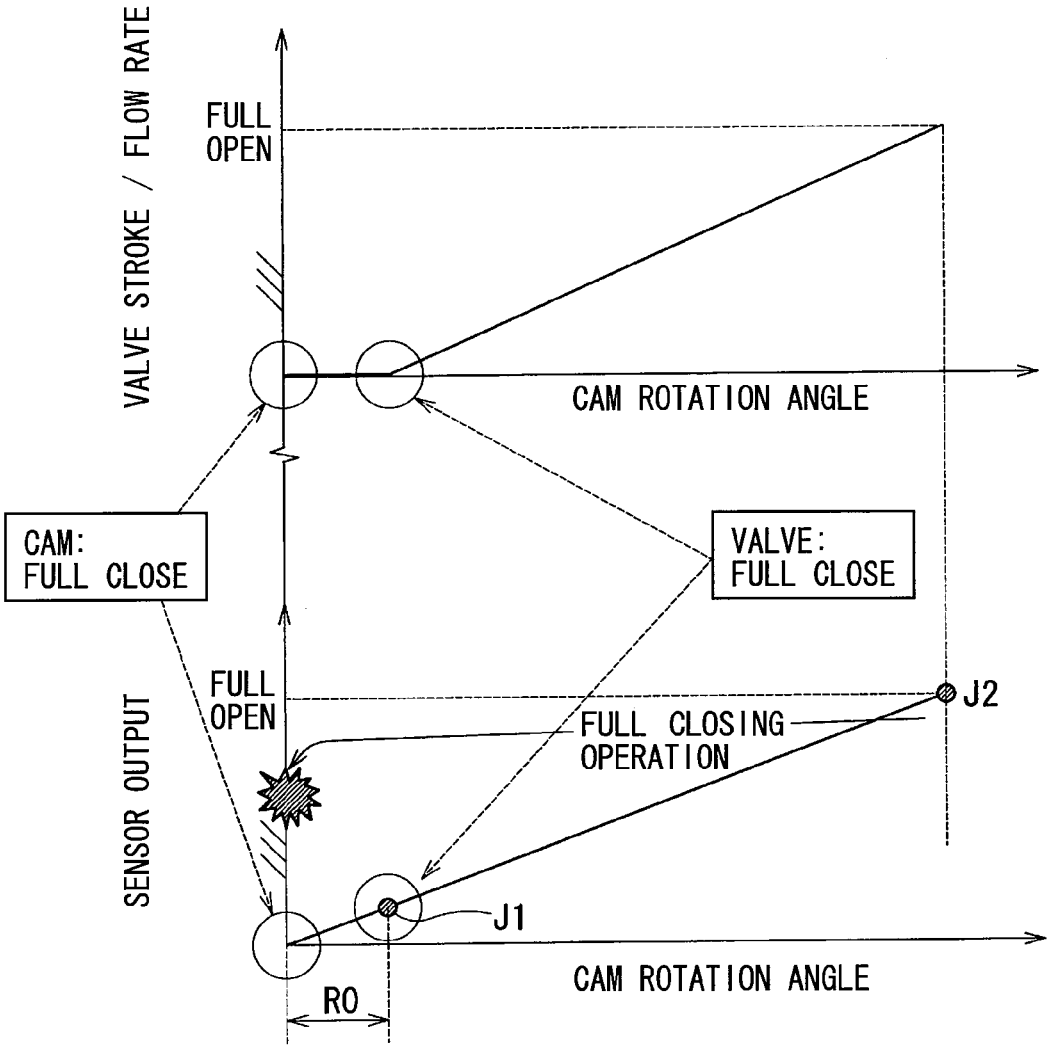
FIG. 8 RELATED ART
FIG. 8 is an explanatory drawing illustrating a valve stroke and a sensor output with respect to a cam rotation angle in a valve control device of a related art.

According to the first embodiment, in the EGR valve control device, the rotation angle sensor 4 is used to adjust the sensor output characteristics with respect to the rotation angle of the plate cam 3 at plural such as three points, while the sensor output is adjusted with respect to the cam rotation angle at two points in the conventional technology shown in FIG. 8. Therefore, as shown in FIG. 5, the sensor output is adjusted in a manner that the cam full close position corresponding to the cam full close stopper 33 has a predetermined adjustment amount relative to the valve full close position.

In the sensor output adjustment at the time of shipment, the sensor output write point P0 of the cam full close position, the sensor output write point P1 of the valve full close position, and the sensor output write point P2 of the valve full open position are written in the EEPROM of the microcomputer 7 of the rotation angle sensor 4. Thus, the position relationship of the cam full close position to the valve full close position, which is indicated by a dimension S0 in FIG. 5, can be accurately detected. In other words, the sensor output difference of the integrated circuit 6 can be accurately detected.

Accordingly, when the full close operation of the poppet valve 1 is carried out by using the power of the motor M, that is, at the full close control time of the poppet valve 1, due to the dimension S0, the engagement part (the ball bearing 24, the pivot pin 25 and the like) of the valve stem 2 is restricted from colliding the cam full close stopper 33. Therefore, the durability of the plate cam 3 and the actuator can be improved. Moreover, the quality reliability of the plate cam 3 and the actuator can be improved.

Second Embodiment

A valve control device according to a second embodiment will be described with reference to FIG. 6. Here, the same code as the first embodiment shows the same composition or function, and its explanation is omitted.

A comparison example in the second embodiment will be described with reference to FIG. 9. As mentioned above, the position relationship between the cam full close position and the valve full close position is not known in the conventional technology. For this reason, as shown in FIG. 9, when the poppet valve is fully closed using the driving force of the motor, the operating speed of the poppet valve may be gradually slowed down toward the valve full close position just before the poppet valve arrives at the valve full close position.

Figure 9:
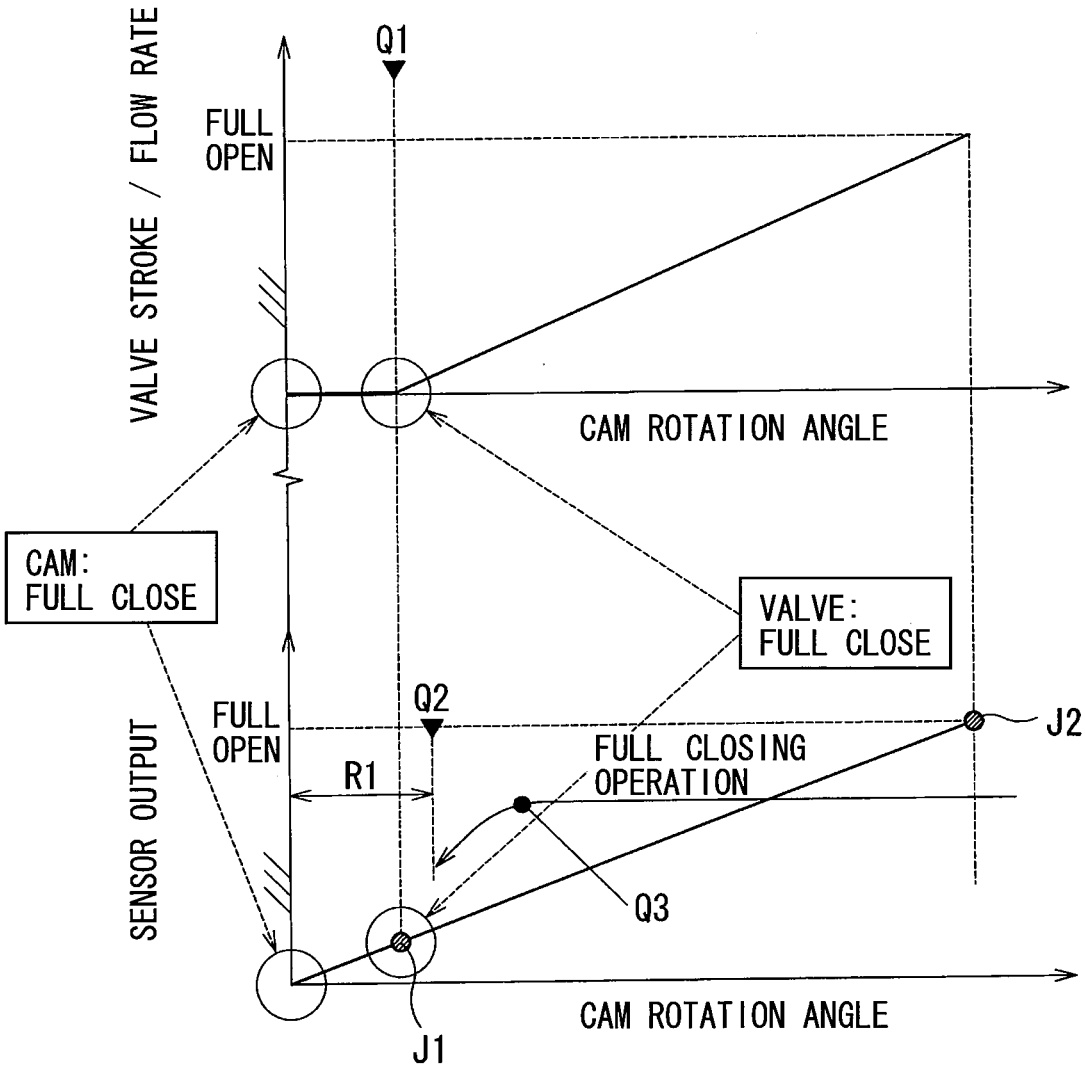
FIG. 9 RELATED ART
FIG. 9 is an explanatory drawing illustrating a valve stroke and a sensor output with respect to a cam rotation angle in a valve control device of a related art.

Specifically, a position Q2 is set to define a dimension R1 in FIG. 9 which is larger than the dimension R0 in FIG. 8, so the poppet valve is delayed to reach a position Q1 corresponding to the valve full close position J1.

However, in this case, quick responsitivity cannot be obtained because the operation speed is slowed down. That is, the braking will work to the operation too early at a position Q3 sufficiently distanced from the cam full close stopper. If the poppet valve is delayed to arrive at the valve full close position and is delayed to be seated on the valve seat, the EGR gas may leak to the intake passage. In this case, fresh air which passed the air cleaner is mixed to the EGR gas, so an engine stall may be generated.

Here, the point J1 in FIG. 9 represents the sensor output write point of the valve full close position, and the point J2 in FIG. 9 represents the sensor output write point of the valve full open position.

Figure 6:
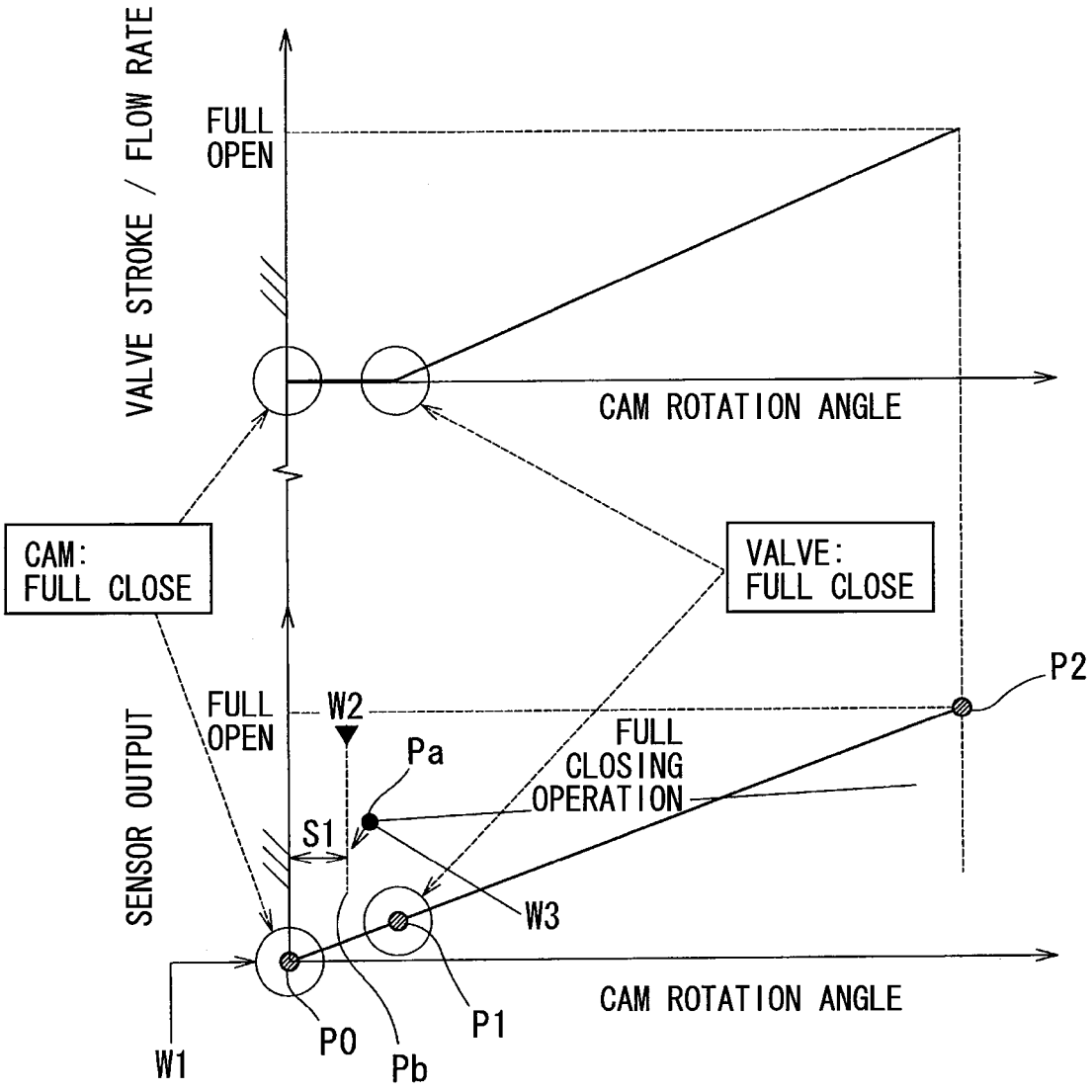
FIG. 6 is an explanatory drawing illustrating a valve stroke and a sensor output with respect to a cam rotation angle in a valve control device according to a second embodiment.

Then, as shown in FIG. 6, the rotation angle detector of the second embodiment has a determining unit (the integrated circuit 6, the microcomputer 7, the ECU 10) which determines a brake position Pa at which the operating speed of the plate cam 3 starts to be slowed down gradually toward the control set point (target position: Pb) at the time when the poppet valve 1 is controlled to be fully closed (at the time of full close operation).

In other words, the determining unit carries out the full close operation at the same operating speed until the rotation angle of the plate cam 3, which can be obtained by acquiring the sensor output of the rotation angle sensor 4, passes the valve full close position P1. Then, when the sensor output of the rotation angle sensor 4 passes the brake position Pa, the deceleration control to gradually slow down is carried out toward the target position Pb, thereby instructing the exact position W2 not to contact the cam full close stopper 33.

Here, the point P0 in FIG. 6 represents the write point of the sensor output at the cam full close position, and a dimension S1 between the point P0 and the target position Pb is smaller than the dimension R1 in FIG. 9. That is, the cam full close position P0 with respect to the valve full close position P1 can be accurately known around an area of W1.

The point P1 in FIG. 6 represents the write point of the sensor output at the valve full close position. The point P2 in FIG. 6 represents the write point of the sensor output at the valve full open position.

In addition, in the memory (EEPROM) of the microcomputer 7, similarly to the first embodiment, the initial data is memorized beforehand as to the data table shown in the upper part of FIG. 6 which represents the correspondence relationship between the cam rotation angle and the valve stroke (or flow rate) in a predetermined format and the data table shown in the lower part of FIG. 6 which represents the correspondence relationship between the cam rotation angle and the sensor output of the integrated circuit 6 in a predetermined format.

According to the second embodiment, approximately the same advantages can be obtained as the first embodiment.

Moreover, the position relationship of the exact cam full close position relative to the valve full close position is detectable. Here, the position relationship corresponds to the difference in the sensor output of the integrated circuit 6. Therefore, when the poppet valve 1 is controlled to be fully closed, quick control response is realizable, and gas leak is decreased. In other words, the position of the cam full close stopper 33 is known correctly, therefore the brake position Pa can be brought close to the cam full close stopper 33 at the time of the full close operation of the poppet valve 1. That is, the brake timing can be delayed, compared with the related art shown in FIG. 9. Thus, the poppet valve 1 can be quickly fully closed at the time of EGR cut, so EGR gas is restricted from mixing into fresh intake air which passed the air cleaner. Thereby, an engine stall can be prevented.

Third Embodiment

A valve control device according to a third embodiment will be described with reference to FIG. 7. Here, the same code as the first and second embodiments shows the same composition or function, and its explanation is omitted.

A comparison example in the third embodiment will be described with reference to FIG. 10. The characteristic line of the data table in FIG. 10 has a gradient A, and the stroke speed of the poppet valve has a constant value. Here, the stroke speed is computed based on a variation amount in the sensor output to a certain time period.

Figure 10:
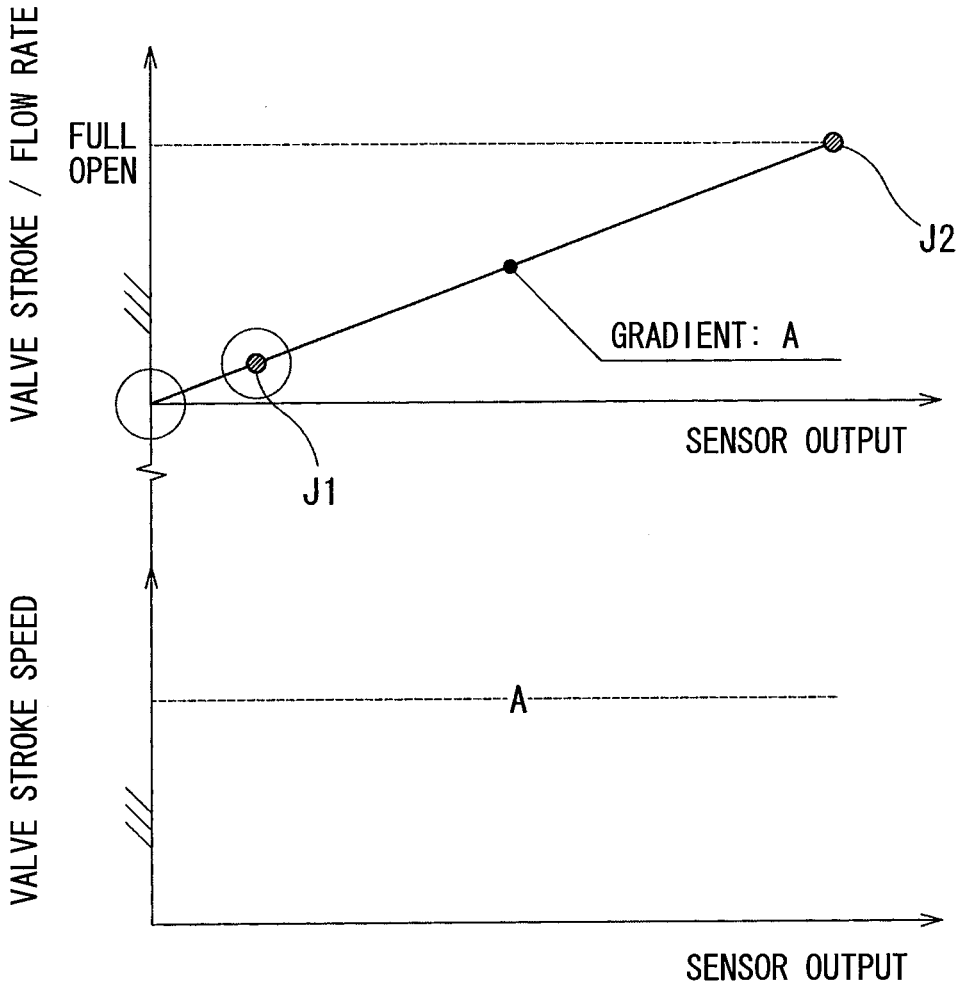
FIG. 10 RELATED ART
FIG. 10 is an explanatory drawing illustrating a valve stroke and a valve stroke speed with respect to a sensor output in a valve control device of a related art.

The point J1 in FIG. 10 represents the write point of the sensor output at the valve full close position. The point J2 in FIG. 10 represents the write point of the sensor output at the valve full open position.

In the comparison example, the cam full close position with respect to the valve full close position is not known.

Figure 7:
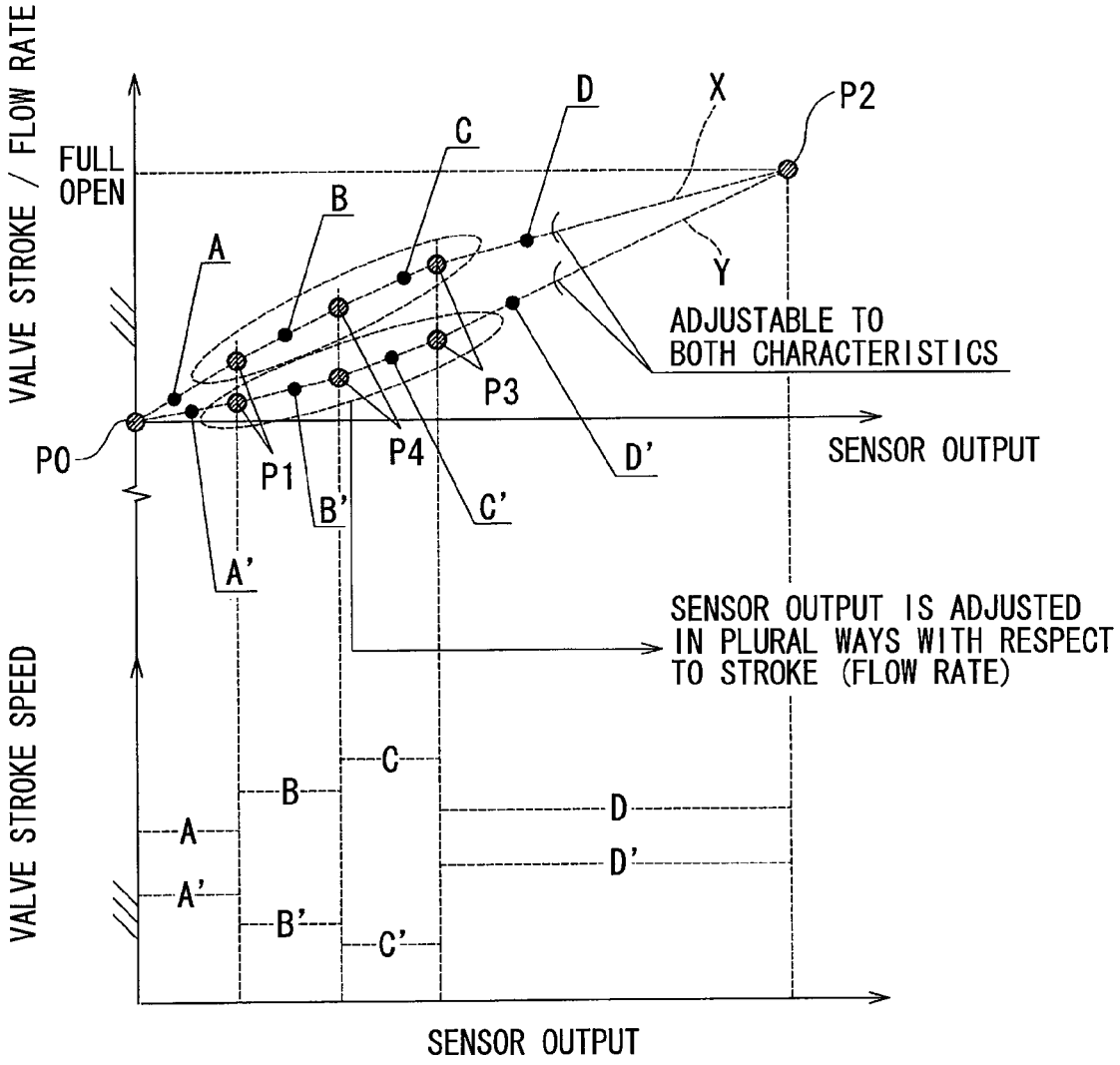
FIG. 7 is an explanatory drawing illustrating a valve stroke and a valve stroke speed with respect to a sensor output in a valve control device according to a third embodiment.

According to the third embodiment, the rotation angle detector has a determining unit (the integrated circuit 6, the microcomputer 7, the ECU 10) which adjusts the output characteristics of the integrated circuit 6 to have a predetermined gradient A, B, C or D, as shown in FIG. 7, between two points adjacent with each other, from among plural points.

The point P0 in FIG. 7 represents the write point of the sensor output at the cam full close position. The point P1 in FIG. 7 represents the write point of the sensor output at the valve full close position which corresponds to a first inflection point, in each of the sensor output characteristics X, Y. The point P4 in FIG. 7 represents the write point of the sensor output at an intermediate position, which corresponds to a second inflection point, in each of the sensor output characteristics X, Y. The point P3 in FIG. 7 represents the write point of the sensor output at an intermediate position, which corresponds to a third inflection point, in each of the sensor output characteristics X, Y. The point P2 in FIG. 7 represents the write point of the sensor output at the valve full open position.

The sensor output of the integrated circuit 6 is adjusted at the plural points P1, P4, P3 with respect to the stroke amount of the poppet valve 1 (valve stroke or flow rate).

In the upper part of FIG. 7, the sensor output characteristics X, which is a characteristic line of the data table, has the gradient A between the two adjacent points P0, P1. The sensor output characteristics X has a gradient B between the two adjacent points P1, P4, a gradient C between the two adjacent points P4, P3, and a gradient D between the two adjacent points P3, P2.

In the lower part of FIG. 7, the data table represents the valve stroke speed with respect to the sensor output having the respective gradients A, B, C, D. The data table is a characteristics line representing a variation in the valve stroke speed with respect to the sensor output voltage.

In the upper part of FIG. 7, the sensor output characteristics Y, which is a characteristic line of the data table, has the gradient A' between the two adjacent points P0, P1. The sensor output characteristics Y has a gradient B' between the two adjacent points P1, P4, a gradient C' between the two adjacent points P4, P3, and a gradient D' between the two adjacent points P3, P2.

In the lower part of FIG. 7, the data table represents the valve stroke speed with respect to the sensor output having the respective gradients A', B', C', D'. The data table is a characteristics line representing a variation in the valve stroke speed with respect to the sensor output voltage.

In addition, the initial data as to the data table shown in FIG. 7 is beforehand memorized by the memory (EEPROM) of the microcomputer 7.

According to the third embodiment, approximately the same advantages can be obtained as the first and second embodiments.

Moreover, the output characteristics of the integrated circuit 6 is adjusted to have the predetermined gradient A-D, A'-D' between the two adjacent points which are adjacent with each other among the plural points. Therefore, the correspondence relationship between the sensor output near the valve full close position and the valve stroke (or the flow rate) can be adjusted in plural ways. Thus, the stroke speed of the poppet valve 1 (or the operating speed of the plate cam 3) can be adjusted according to the rotation angle of the plate cam 3.

That is, the stroke speed of the poppet valve 1 (or the operating speed of the plate cam 3) can be changed at each inflection point P1, P4, P3. Therefore, the adjustment can be possible between a first case where the poppet valve 1 is required to be fully closed quickly like the sensor output characteristics X and a second case where the poppet valve 1 is required to be fully closed slowly like the sensor output characteristics Y.

When the poppet valve 1 is fully closed quickly, an engine stall can be prevented. When the poppet valve 1 is fully closed slowly, the impact to the cam full close stopper 33 can be reduced.

(Modifications)

The present disclosure may be applied to a valve control device which controls an exhaust control valve of an internal combustion engine, or a valve control device which controls an intake control valve of an internal combustion engine, instead of the EGR valve control device which controls the EGR control valve.

The exhaust control valve may be a waste gate valve, a scroll switch valve, an exhaust gas flow control valve, an exhaust gas pressure control valve, an exhaust gas switch valve, or an exhaust gas throttle valve.

The intake control valve may be an intake throttle valve, a tumble flow control valve, or a swirl flow control valve.

The EGR control valve is not limited to have the poppet valve 1. The poppet valve 1 may be replaced with a rotation type valve such as a butterfly valve, a flap valve, a plate valve, or a rotary valve, by interposing a link mechanism between the valve body and the valve shaft. A double poppet valve may be used instead of the poppet valve.

The valve shaft may be made of an operating rod extending in the axial direction instead of the valve stem 2.

The internal combustion engine may be a multi-cylinder gasoline engine or a single-cylinder engine instead of the multi-cylinder diesel engine.

The actuator which drives the rotation shaft (output gear shaft 14) of the plate cam 3 is not limited to the electric actuator having the motor M which generates torque in response to supply of electric power and the deceleration mechanism (power transmission device) which slows down the rotation of the motor M. The actuator may be a negative-pressure operation type actuator driven with the negative pressure supplied from an electric vacuum pump through a negative-pressure control valve, or a linear solenoid (electromagnetism actuator) which has an electromagnet including a coil.

In the case of the negative-pressure operation type actuator or the electromagnetism actuator, it is desirable to prepare a converter such as a link mechanism to the cam rotation shaft. The converter changes the rectilinear motion of the output unit of the actuator into a rotary motion of the cam.

In addition, a sensor element which outputs an analog signal may be a non-contact type magnetic detector such as Hall device or magnetic reluctance (MR) element, which detects the flux of magnetic induction (magnetism) emitted from the magnet fixed to the cam or the rotation shaft of the cam.

Moreover, the writing of the valve full open position, the valve full close position and the cam full close position to the storage part of the signal processor may be conducted by an external computer outside the sensor (vehicle) instead of the signal processor.

The full open stopper 19 is arranged to define the valve full open position which is a limit position, on the valve full open side, of the movable region of the poppet valve 1 in the above embodiment. Alternatively, a full close stopper may be arranged to define the valve full close position which is a limit position, on the valve full close side, of the movable region of the poppet valve 1. Both or either one of the full open stopper 19 and the full close stopper may be provided.

To sum up the present disclosure, the valve control device includes the valve unit which opens and closes a passage, the cam which has a slot shaped to correspond to the operation pattern of the valve unit, the actuator which drives the rotation shaft of the cam, the cam full close stopper which specifies the cam full close position that is a cam-full-close side limit position of the rotatable range of the cam, and the rotation angle detector which detects the rotation angle of the cam. The rotation angle detector has the sensor, and the sensor output characteristics can be adjusted at a plurality of points with respect to the rotation angle of the cam. The sensor has the sensor element which outputs the signal corresponding to the rotation angle of the cam and the signal processor which changes the signal outputted from the sensor element into a predetermined sensor output.

The signal processor has the storage part which memorizes the data table representing the correspondence relationship between the rotation angle of the cam and the sensor output of the signal processor with a predetermined form. The sensor output of the signal processor is written in the data table of the storage part as a valve full open position at the time when the valve unit is fully opened. The sensor output of the signal processor is written in the data table of the storage part as a valve full close position at the time when the valve unit is fully closed. The sensor output of the signal processor is written in the data table of the storage part as a cam full close position at the time when the cam is operated to be fully closed to contact the cam full close stopper.

Accordingly, since the valve full open position, the valve full close position, and the cam full close position are written in the storage part of the signal processor of the sensor, it becomes possible to detect the spatial relationship of the exact cam full close position to the valve full close position. The spatial relationship may corresponds to a difference in the sensor output of the signal processor. Thereby, since the collision to the cam full close stopper can be prevented at the time when the valve unit is fully closed, the durability of the cam or the actuator can be improved. Moreover, the quality reliability of the cam, the actuator, etc. can be improved.

In addition, the valve control device may further include a valve full close stopper which specifies the valve full close position which is a valve-full-close side limit position of the movable region of the valve unit. Moreover, the valve control device may further include a valve full open stopper which specifies the valve full open position which is a valve-full-open side limit position of the movable region of the valve unit.

The rotation angle detector may include a detecting element (ECU) which detects the stroke amount of the valve unit or the rotation angle of the cam based on the sensor output of the signal processor. The ECU controls the actuator (i.e., the motor) so that the detection value of the stroke amount of the valve unit or the rotation angle of the cam agrees with the control set (target) point. That is, the detecting element may be a control unit which takes in the sensor output of the signal processor so as to detect the opening (stroke or flow rate) of the valve unit and which determines the controlled variable of the actuator such as the motor such that the opening of the valve unit may be made to have the target opening.

For example, the brake position is determined at which the stroke speed of the valve unit or the operating speed of the cam starts to be slowed down to a target position gradually at the time when the valve unit is fully closed. Therefore, it becomes possible to detect the spatial relationship of the exact cam full close position to the valve full close position as a difference in the sensor output of the signal processor. By this, control response speed can be made quick and a predetermined flow rate can be maintained at the time when the valve unit is fully closed.

For example, the output characteristics of the signal processor can be adjusted to have a predetermined gradient between two points adjacent with each other among the plurality of points. Therefore, the correspondence relationship between the sensor output near the valve full close position and the stroke (or flow rate) of the valve unit can be adjusted in plural ways. Thus, the stroke speed of the valve unit can be adjusted according to the rotation angle of the cam.

The signal outputted from the sensor element and the sensor output of the signal processor may be analog signals.

In addition, the sensor may be the rotation angle sensor which generates the output corresponding to the rotation angle of the cam. The rotation angle sensor may have a non-contact type magnetic sensing element which detects the flux of magnetic induction emitted from the magnet fixed to the cam, the rotation shaft of the cam, or the interlocking component connected with the cam in the integrally rotatable state.

Such changes and modifications are to be understood as being within the scope of the present disclosure as defined by the appended claims.

What is claimed is:

1. A valve control device usable for Exhaust Gas Recirculation (EGR), the valve control device comprising:

a valve unit which opens and closes a passage by way of a poppet valve connected to a shaft configure to reciprocate in an axial direction;

a cam having a slot shaped to correspond to an operation pattern of the valve unit;

an actuator which drives a rotation shaft of the cam;

a cam full close stopper which defines a cam full close position that is a limit position of a rotatable range of the cam; and a rotation angle detector configured to detect a rotation angle of the cam, wherein the rotation angle detector includes a sensor which is configured to adjust characteristics of sensor output, at a plurality of points, with respect to the rotation angle of the cam, the sensor includes: a sensor element configured to output a signal corresponding to a rotation angle of the cam; and a signal processor configured to change the signal output from the sensor element into a sensor output, the signal processor includes a storage part configured to memorize a data table representing a correspondence relationship between the rotation angle of the cam and the sensor output of the signal processor in a predetermined form, the storage part is configured to memorize the sensor output of the signal processor when the valve unit is fully opened as a valve full open position, the storage part is configured to memorize the sensor output of the signal processor when the valve unit is fully closed as a valve full close position, the storage part is configured to memorize the sensor output of the signal processor when the cam is fully closed at the cam full close position, and when the rotation angle of the cam is changed from the cam full close position to the valve full close position, the valve unit continues to be fully closed.

2. The valve control device according to claim 1, wherein the rotation angle detector includes a detecting element configured to detect a stroke amount of the valve unit or the rotation angle of the cam based on the sensor output of the signal processor.

3. The valve control device according to claim 1, wherein the rotation angle detector includes a determining unit configured to determine a brake position at which a stroke speed of the valve unit or an operating speed of the cam is gradually slowed down toward a target position when the valve unit is operated to be fully closed.

4. The valve control device according to claim 1, wherein the rotation angle detector includes a determining unit configured to adjust the sensor output of the signal processor to have a predetermined gradient between two points adjacent with each other among the plurality of points.

5. The valve control device according to claim 1, further comprising:

a converter configured to convert a rotary motion of the rotation shaft of the cam into a linear motion of the shaft of the valve unit.

6. The valve control device according to claim 5, wherein the converter has a follower movably inserted into the slot, and a pivot which drives the shaft of the valve unit in response to a power of the actuator transmitted from the cam through the follower.

7. The valve control device according to claim 1, wherein the storage part is configured to update the valve full open position, update the valve full close position and update the cam full close position during a predetermined operation of the valve control device.

8. The valve control device according to claim 7, wherein the valve control device is configured to be controlled based upon the updated valve full open position, the updated valve full close position and the updated cam full close position.

9. The valve control device according to claim 1, wherein the poppet valve moves in parallel with the shaft reciprocating in the axial direction, and the poppet valve has a cylindrical flange that is seated on a valve seat to fully close the passage when the rotation angle of the cam is located at the valve full close position.

10. The valve control device according to claim 9, wherein the shaft fails to move in the axial direction when the rotation angle of the cam is changed from the valve full close position to the cam full close position, and the cam full close position is defined by an end of the slot of the cam.

11. The valve control device according to claim 9, wherein the slot of the cam is shaped so that the poppet valve is fully closed at an angular position of the cam between the cam full close position and the valve full open position.

12. The valve control device according to claim 9, wherein the slot has a constant radius for at least a portion of angular rotation of the cam between the cam full close position and the valve full close position.

* * * * *